US009764591B2

(12) United States Patent
Saint

(10) Patent No.: US 9,764,591 B2
(45) Date of Patent: Sep. 19, 2017

(54) COVER WITH A SEAL FOR CLOSING A CAN, AND ASSEMBLY COMPRISING A CAN AND SUCH A COVER

(71) Applicant: FILLON TECHNOLOGIES, Faverolles (FR)

(72) Inventor: Patrick Saint, Chartres (FR)

(73) Assignee: FILLON TECHNOLOGIES, Faverolles (FR)

( * ) Notice: Subject to any disclaimer, the term of this patent is extended or adjusted under 35 U.S.C. 154(b) by 0 days.

(21) Appl. No.: 15/023,097

(22) PCT Filed: Sep. 15, 2014

(86) PCT No.: PCT/FR2014/052283
§ 371 (c)(1),
(2) Date: Mar. 18, 2016

(87) PCT Pub. No.: WO2015/044556
PCT Pub. Date: Apr. 2, 2015

(65) Prior Publication Data

US 2016/0236508 A1 Aug. 18, 2016

(30) Foreign Application Priority Data

Sep. 24, 2013 (FR) ..... 13 59162

(51) Int. Cl.
*B44D 3/12* (2006.01)
*B65D 53/02* (2006.01)

(52) U.S. Cl.
CPC ..... *B44D 3/127* (2013.01); *B65D 53/02* (2013.01); *B65D 2543/00092* (2013.01);
(Continued)

(58) Field of Classification Search
CPC ..... B44D 3/127; B44D 3/12; B65D 53/02
USPC ..... 220/320, 319, 315, 321, 700, 699, 803, 220/804, 802, 801, 806; 277/647, 645, 277/644, 628; 366/247, 245, 244, 242, 366/341, 347
See application file for complete search history.

(56) References Cited

U.S. PATENT DOCUMENTS 4,166,549 A * 9/1979 Schutz ..... B65D 43/0218 220/319
2002/0145939 A1 10/2002 Keough
(Continued)

FOREIGN PATENT DOCUMENTS

GB 880047 10/1961

OTHER PUBLICATIONS

Chinese Office Action for Application No. 201490001072.1 dated Jul. 21, 2016.

*Primary Examiner* — Robert J Hicks
(74) *Attorney, Agent, or Firm* — Ipsilon USA, LLP

(57) ABSTRACT

The invention relates to a lid (1) for closing a can having a tubular side wall (3) provided with a top opening and with an internal radial collar disposed substantially at the same level as said top opening, said lid (1) being provided on its "bottom" face (2) with an elastically deformable annular sealing gasket (4) that is suitable for coming to bear against said collar, when the top opening of the can is in the closed state in which it is closed by said lid (1). In the non-deformed state, said sealing gasket (4) is in the general shape of a half-torus having its convex side facing outwards from the lid (1).

13 Claims, 15 Drawing Sheets

(52) U.S. Cl.
CPC ..... *B65D 2543/00296* (2013.01); *B65D 2543/00435* (2013.01); *B65D 2543/00537* (2013.01); *B65D 2543/00574* (2013.01); *B65D 2543/00629* (2013.01); *B65D 2543/00685* (2013.01); *B65D 2543/00768* (2013.01); *B65D 2543/00805* (2013.01); *B65D 2543/00842* (2013.01); *B65D 2543/00972* (2013.01)

(56) References Cited

U.S. PATENT DOCUMENTS

| | | | |
|---|---|---|---|
| 2005/0023772 | A1 | 2/2005 | England |
| 2013/0334230 | A1 | 12/2013 | Delage et al. |

* cited by examiner

COVER WITH A SEAL FOR CLOSING A CAN, AND ASSEMBLY COMPRISING A CAN AND SUCH A COVER

RELATED APPLICATIONS

This application is a National Phase Application of PCT/FR2014/052283, filed on Sep. 15, 2014, which in turn claims the benefit of priority from French Patent Application No. 13 59162 filed on Sep. 24, 2013, the entirety of which are incorporated herein by reference.

BACKGROUND

Field of the Invention

The present invention relates to a lid having a gasket for closing a can having a tubular side wall, and to an assembly comprising a can having a tubular side wall and a lid of the above-mentioned type.

The present invention relates more particularly to a lid for closing a can having a tubular side wall provided with a top opening and with an internal radial collar disposed substantially at the same level as said top opening, said lid being provided on its "bottom" face with an elastically deformable annular sealing gasket that is suitable for coming to bear against said collar, when the top opening of the can is in the closed state in which it is closed by said lid.

Description of Related Art

Such a lid is well known to persons skilled in the art, as illustrated by Patent FR 2011 707 258 in which a flat annular gasket is described.

Due to its design, such a gasket is difficult to adapt to certain complex can collar shapes. Also, due to its flat shape, such a gasket has a limited spring effect.

An object of the present invention is thus to propose a lid of the above-mentioned type in which the design of the gasket makes it possible to adapt the gasket to multiple can collar shapes, to procure an improved spring effect, and to procure assistance with centering the lid on the can.

For this purpose, the invention provides a lid for closing a can having a tubular side wall provided with a top opening and with an internal radial collar disposed substantially at the same level as said top opening, said lid being provided on its "bottom" face with an elastically deformable annular sealing gasket that is suitable for coming to bear against said collar, when the top opening of the can is in the closed state in which it is closed by said lid, said lid being characterized in that in the non-deformed state, said sealing gasket is in the general shape of a half-torus having its convex side facing outwards from the lid, i.e. towards the can.

Because of the convex shape of the gasket that faces outwards from the lid rather than towards the lid, the spring effect of the gasket is improved, in the direction in which the lid moves away from the can, and, in the presence of fastener means for fastening the lid to the can and formed by fastener means of the lid that come into engagement with the internal radial collar or with an external peripheral rim of the can, this improved spring effect tends to increase the pressure force exerted by the fastener means for fastening the lid to the can, thereby making it possible to increase the effectiveness of the fastening.

Also, the convex shape enables the gasket to adapt to a large number of can internal radial collar shapes.

Finally, the convex shape of the gasket assists with centering the lid, relative to the can.

OBJECTS AND SUMMARY

Preferably, the half-torus is hollow. This hollow implementation of the half-torus facilitates deformation of the gasket and adaptation of the gasket to complex collar shapes.

Preferably, the half-torus is open on its face that faces towards the lid. Once again, this implementation facilitates deformation of the gasket and, in particular, flattening of the gasket, and adaptation of the gasket to complex collar shapes.

Preferably, the half-torus that has an inner circumferential edge and an outer circumferential edge is connected to the lid via a connection zone disposed at one of its circumferential edges, and in that the other circumferential edge of the half-torus is free.

This circumferential edge of the half-torus that does not have a connection zone for connecting to the lid is therefore a free edge, i.e. an edge that is not hindered from deforming by any connection zone for connecting to the edge of the lid. As a result, its leaktightness is improved, and it is more adaptable to the various can shapes. Also, the absence of a connection at its circumferential edge prevents the gasket from being marked or nipped.

In a variant, the half-torus that has an inner circumferential edge and an outer circumferential edge is connected to the lid via a connection zone disposed at each of its circumferential edges. Nevertheless, the absence of the possibility of flattening of the gasket can adversely affect its effectiveness.

Preferably, the sealing gasket is fastened to the lid via an annular band or via an annular snap ring, said snap ring defining an open ring.

Preferably, when a band is used, the band is engaged in an annular recess in the bottom face of the bottom of the lid. In particular, the band is engaged by force in said recess.

Preferably, when a band is used, the band and gasket are overmolded.

Preferably, when an annular snap ring is used, said snap ring is received inside the gasket and acts by thrusting on the inner circumferential edge of the gasket to engage it into an annular groove provided in the bottom face of the lid.

Preferably, the lid is provided with a handle, and, preferably the lid is also provided with a central opening designed for the rotary shaft of a mixer assembly.

Preferably, the lid also has fastener means for fastening the lid to the can. In general, said fastener means are configured to make it possible to press the gasket of the lid against the internal radial collar of the can, while said fastener means are going from an inactive position to an active fastening position in which they fasten to the can.

In a first embodiment invention, the fastener means comprise two rotary cam levers that are spring-loaded by springs, and that are movable axially by "complementary" surfaces carried respectively by the lid and by the cam lever co-operating while the cam levers are being driven in rotation to go from a closed position in which the lid is closed and in which the cam comes to bear under the collar of the can to an open position in which the cam is disengaged from said collar, axial movement of the cam lever in the direction in which the lid moves farther away from the cam causing compression of the spring.

In a second embodiment of the invention in which the lid is of the type for closing a can also provided with an external radial peripheral rim disposed substantially at the same level as said top opening, the fastener means comprise at least two catches extending around said gasket, and at least partially projecting from the bottom face of the lid, at least one of the catches being mounted to move closer to or farther away from the other catches, at least two of or each of the catches having an active fastener portion formed by a portion of the catch that projects towards the center of the lid, this active fastener portion being suitable for coming to position itself under said external radial peripheral rim of the can when said catches are in the closer position corresponding to the active closure position of the lid.

These catches may be merely elastically deformable catches.

Preferably, for causing the active fastener portion of one of the movable catches provided with active fastener portions to move between a closer position in which it is closer to the active fastener portions of the other catches and a farther-away position in which it is farther away from the active fastener portions of the other catches, said one of the movable catches provided with active fastener portions is mounted to move about an axis, or in a plane substantially parallel to a circumferential plane of the annular sealing gasket, and, for said at least one movable catch, the lid is provided with locking means for locking said movable catch so as to prevent it from pivoting in the closer position in which its active fastener portion is closer to the active fastener portion(s) of the other catch(es), these locking means being unlockable.

Preferably, the movable catch is a pivotally mounted catch and the locking means are at least partially elastically deformable and are suitable for going from the locked position to the unlocked, position, and vice versa, by elastic deformation combined with pivotal movement of the pivotally movable catch.

Preferably, the locking means comprise first locking means mounted to be constrained to move with the pivotally movable catch and stationary second locking means, said first and second locking means being coupled together in the locked position and decoupled in the unlocked position.

Preferably, said first and second locking means are of the male/female type.

Preferably, the active fastener portion of said at least one pivotally movable catch is elastically deformable.

Preferably, the pivotally movable catch or at least one of the pivotally movable catches is mounted to move pivotally via a control lever for causing it to move pivotally, and the first locking means for preventing pivotal movement of said pivotally movable catch are carried by said control lever and the second locking means are carried by the handle.

Preferably, the "top" face of the lid that is opposite from its bottom face forms a pouring spout, said pouring spout having a seat for a closure member, said seat sloping downwards from the outer peripheral edge towards the center of the lid, said closure member being equipped with return means for urging it back into the closed position, and with a pivotally mounted control lever for opening the active closure flap against the action of said return means.

The slope of the seat makes it possible to reduce the control force to be applied to said control lever for opening the closure flap.

The invention further provides an assembly of the type comprising firstly a can having a tubular side wall provided with a top opening and with an internal radial collar disposed substantially at the same level as said top opening, and secondly a lid for closing the can, said lid being dimensioned to cover the top opening of the can, said lid being provided on its "bottom" face with an elastically deformable annular sealing gasket that is suitable for coming to hear against said collar, when the top opening of the can is in the closed state in which it is closed by said lid.

BRIEF DESCRIPTION OF THE DRAWINGS

The invention can be well understood on reading the following description of embodiments given with reference to the accompanying drawings, in which.

DETAILED DESCRIPTION

Figure 1A:
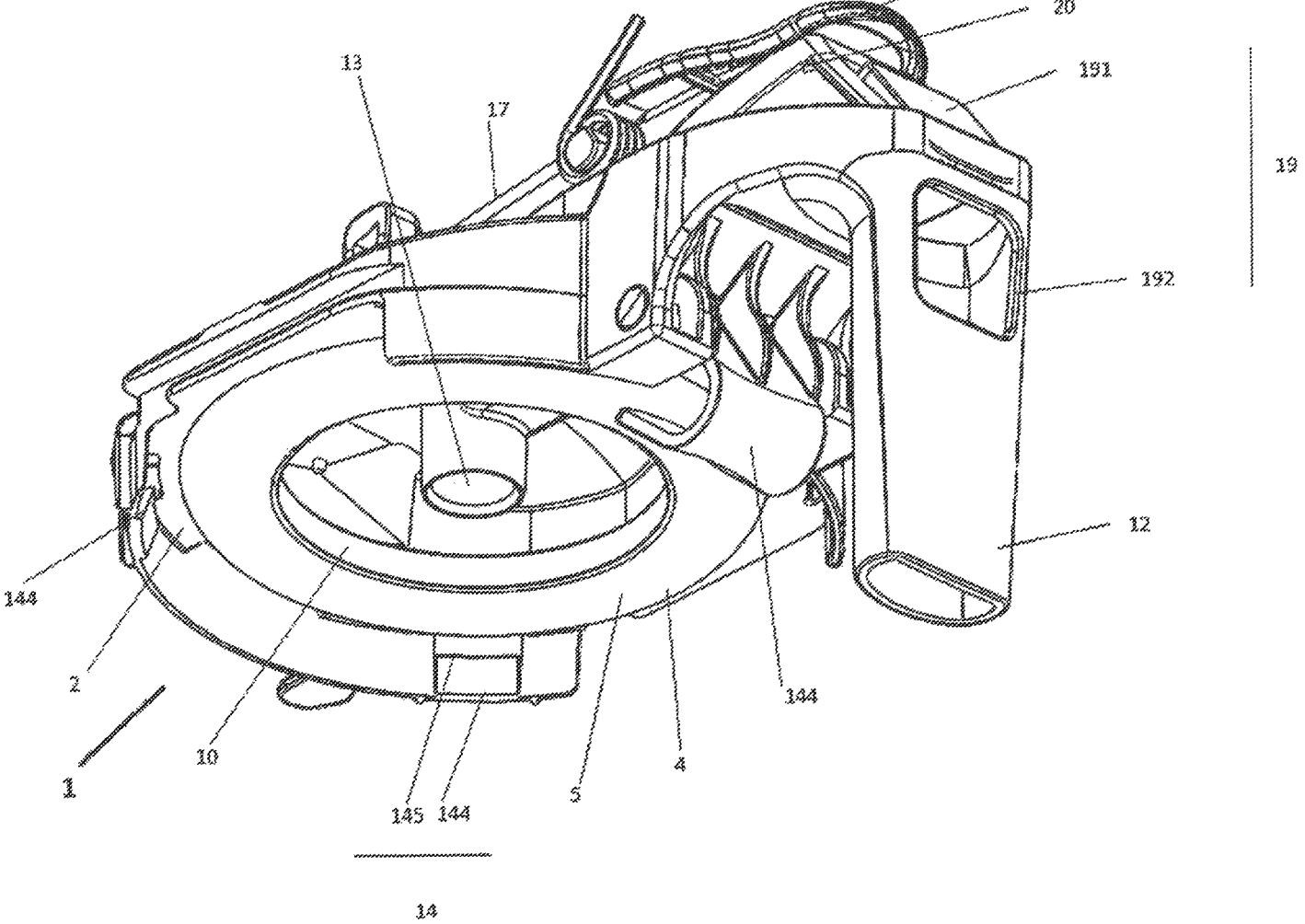
FIG. 1A is a perspective view of a lid of the invention with said pivotally movable catch in the unlocked position, and with the active fastener portion of the pivotally movable catch in the farther-away position in which it is farther away from the active fastener portions of the other catches.

As mentioned above, the invention relates to a lid 1 for closing a can 30, and to the assembly made up of the lid and of the can.

As shown in the figures, the can 30, such as a can of paint, has a tubular side wall 31 that, in the vicinity of one end, is provided with an internal radial collar 32 defining a top opening 34 that is substantially circular.

Said tubular side wall 31 of the can is also provided with an external radial peripheral rim 33 also disposed substantially at the same level as the top opening 34 and at the same level as the internal radial collar 32.

The top opening 34 of the can 30 is suitable for being closed by the lid 1. The lid 1 has a bottom face provided with an annular sealing gasket 4 suitable for coming to bear against said collar 32 when the top opening 34 of the can 30 is in the closed state in which it is closed by said lid.

In the non-deformed state, said sealing gasket 4 is in the general shape of a half-torus having ins convex side facing outwards from the lid 1.

The convex surface 5 of the gasket 4 thus faces outwards from the lid, so that the face 6 of the gasket 4 that faces towards the bottom face of the lid 1 corresponds to the face of the gasket that contains the section plane of the half-torus.

In the examples shown, this half-torus is hollow and open on its face 6 that faces towards the lid 1.

Naturally, in a variant, the half-torus may be solid, but that solution is not preferred.

This sealing gasket 4 has an inner circumferential edge 7, an outer circumferential edge 8, and a connection zone 9 for connecting to the lid 1 and disposed at one of its circumferential edges.

In the example shown, the connection zone 9 is disposed at the inner circumferential edge 7 of the sealing gasket 4, and the outer circumferential edge 8 is free.

Naturally, it is also possible to imagine a solution in which the connection zone 9 for connecting to the lid is disposed at the outer circumferential edge of the gasket while the inner circumferential edge of the gasket is free.

Likewise, it also possible, while not being preferred, to imagine a solution in which a connection zone for connecting to the lid is disposed at each of the circumferential edges of the gasket.

In the examples shown in FIGS. 1 to 10, the sealing gasket 4 is fastened to the lid via an annular band 10. This annular band is secured to or integral with the inner circumferential edge of the gasket and is received by being engaged by force into an annular recess provided in the bottom face of the lid. Ideally, the annular band 10 is overmolded onto the gasket, thereby avoiding any risk of mounting error.

Figure 13:
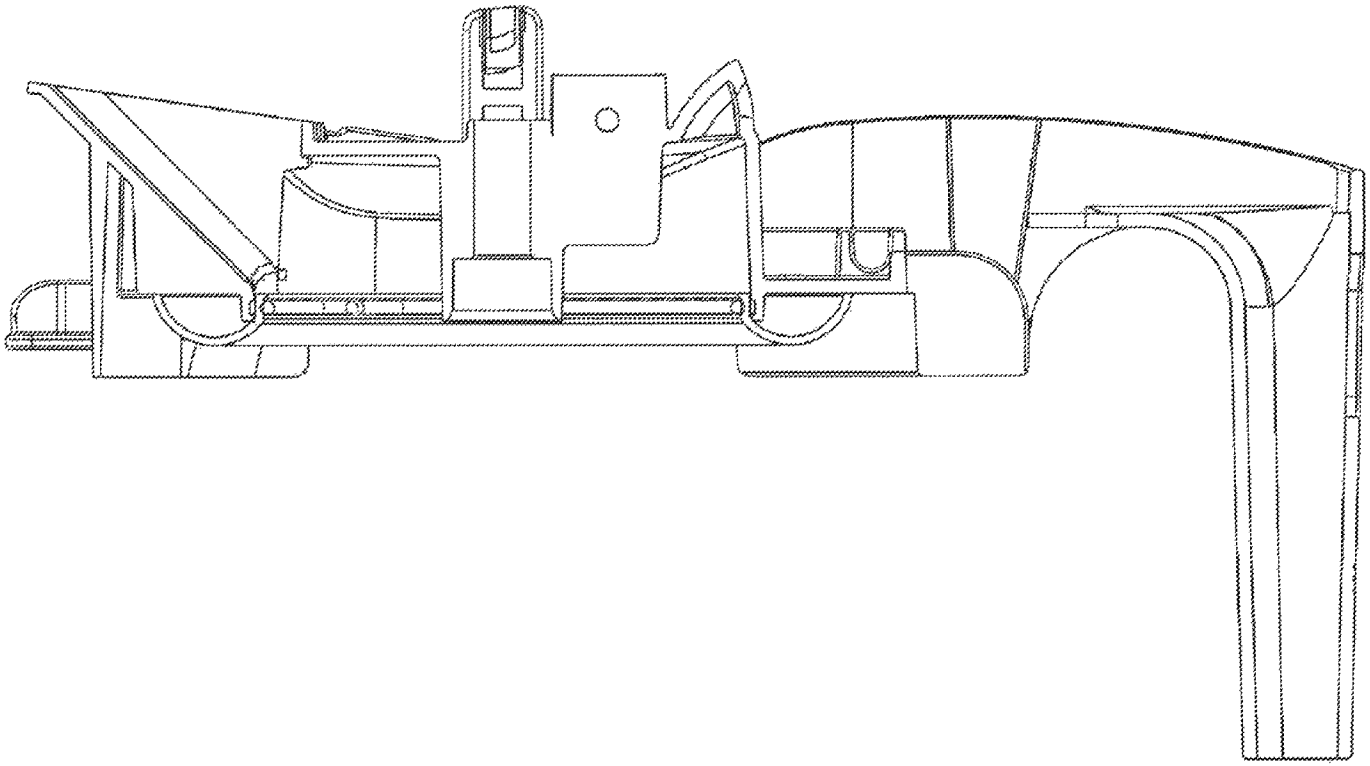
FIG. 13 is a section view of a lid with its gasket and the fastener means for fastening the gasket to the lid.
Figure 14:
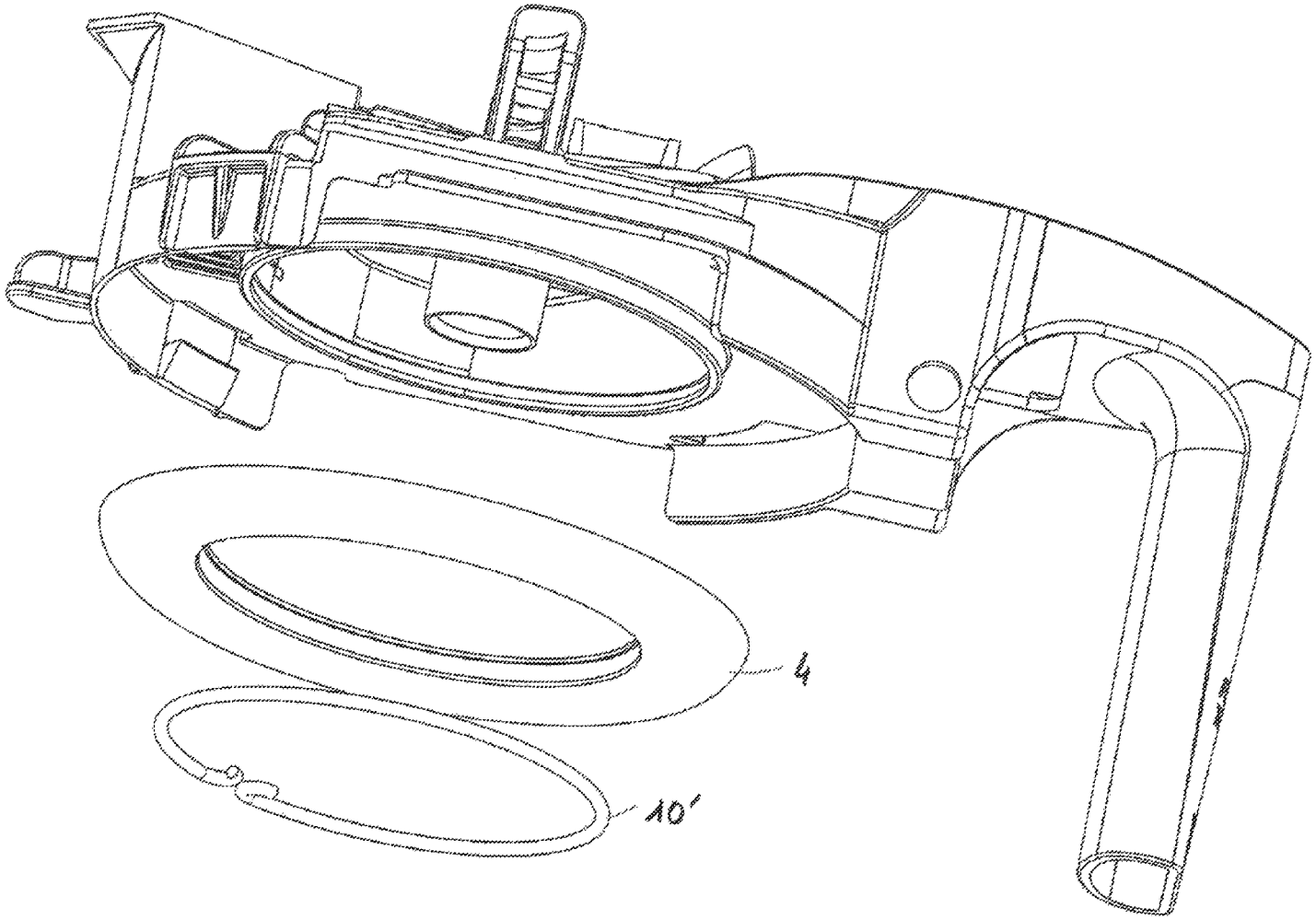
FIG. 14 is a perspective view of an assembly comprising the lid, the gasket, and the fastener snap ring for fastening the gasket, with these component elements of the assembly shown in exploded manner.

In the example shown in FIGS. 13 and 14, the sealing gasket 4 is fastened to the lid via an elastically deformable annular snap ring 10' that defines an open ring. The free ends of the snap ring are curved over so as to form bearing surfaces for the fingers of an operator so that, by reducing the diameter of the ring formed by the snap ring, by bringing the free ends closer together, it is possible to engage the snap ring into the gasket. Releasing the snap ring causes the diameter of the ring to increase, by the ends of the snap ring moving apart. By means of this increase in diameter, the snap ring generates thrust against the inner circumferential edge of the gasket, thereby causing said edge of the gasket to be inserted into an annular groove provided in the bottom face of the lid.

The lid, also has fastener means 14 for fastening the lid 1 to the can 30.

Figure 1B:
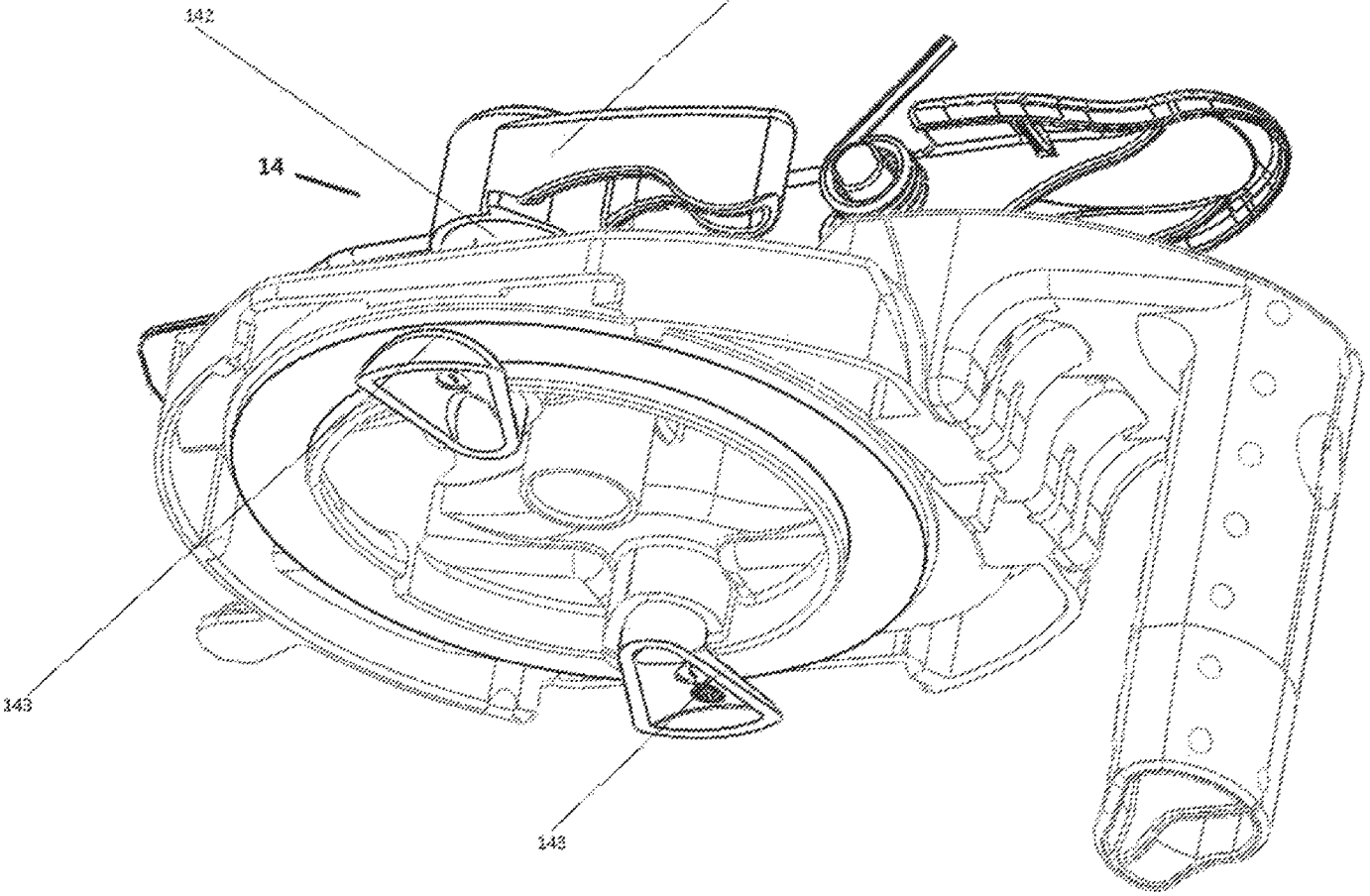
FIG. 1B is a perspective view of a lid equipped with cam levers.
Figure 2:
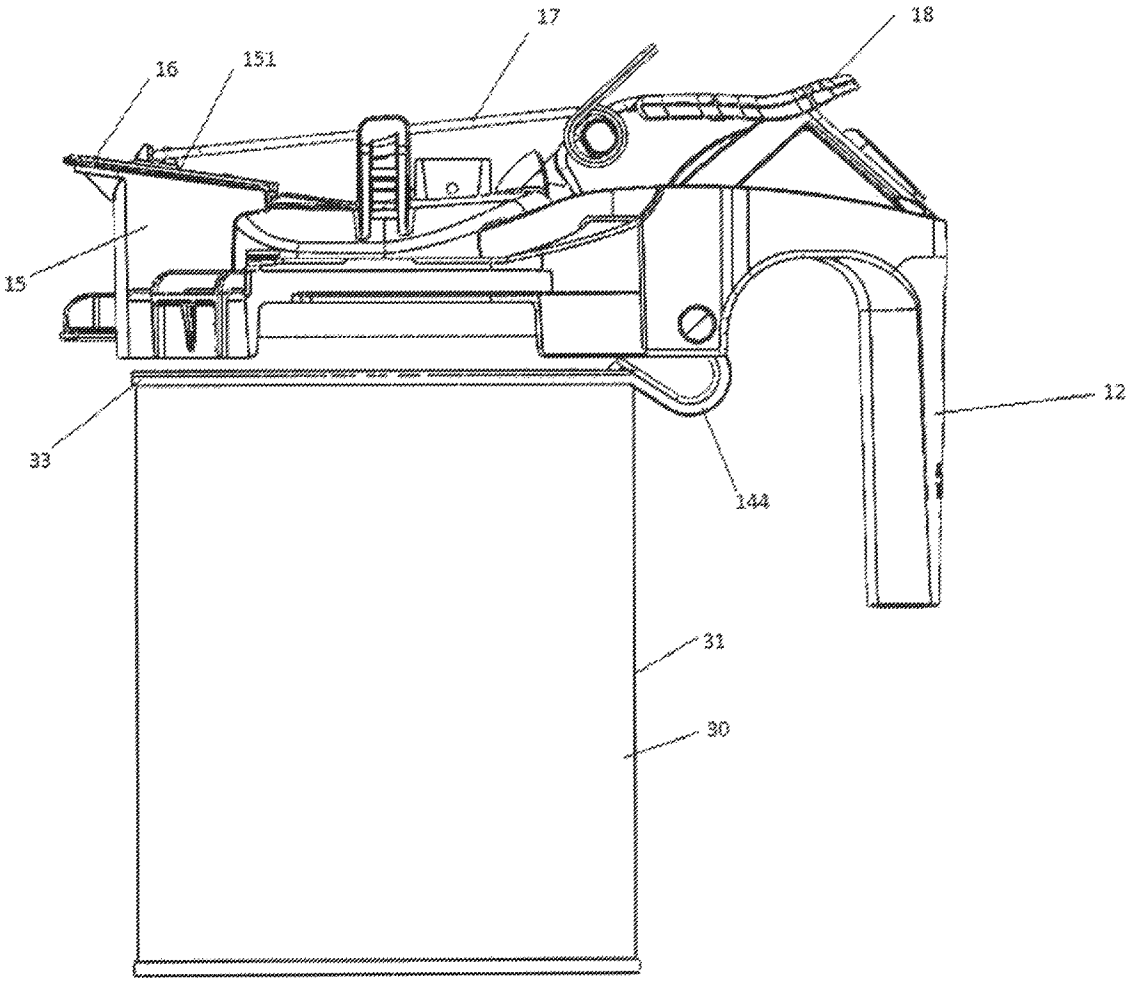
FIG. 2 is a side view of a can-and-lid assembly while the lid is being fastened to the can, the lid being positioned above the top opening of the can.
Figure 3:
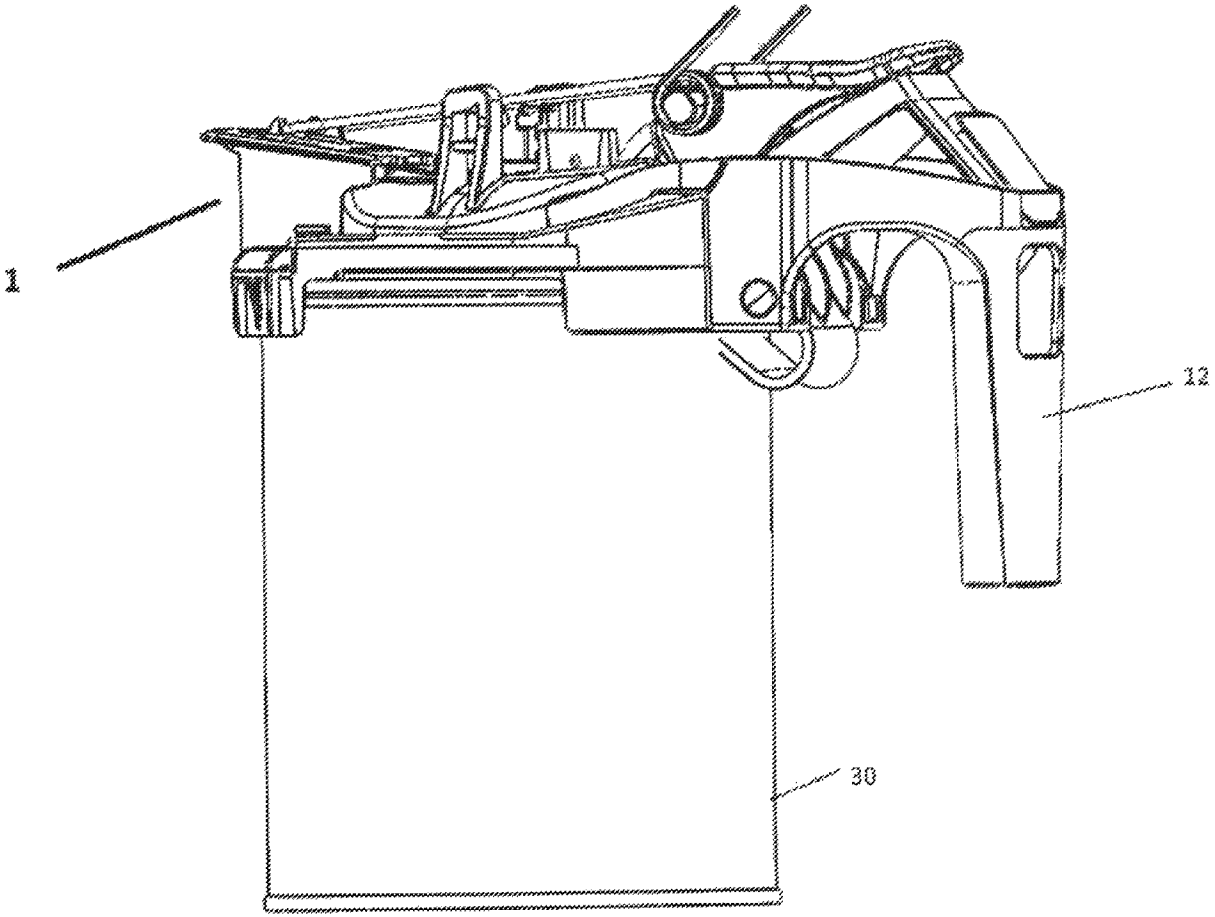
FIG. 3 is a perspective view of a can-and-lid assembly in which the active fastener portions of the catches of the lid are positioned on the can at a level lower than the external radial peripheral rim of the can, the movable catch being in the unlocked position, with its active fastener portion farther away from the active fastener portions of the other catches.
Figure 4:
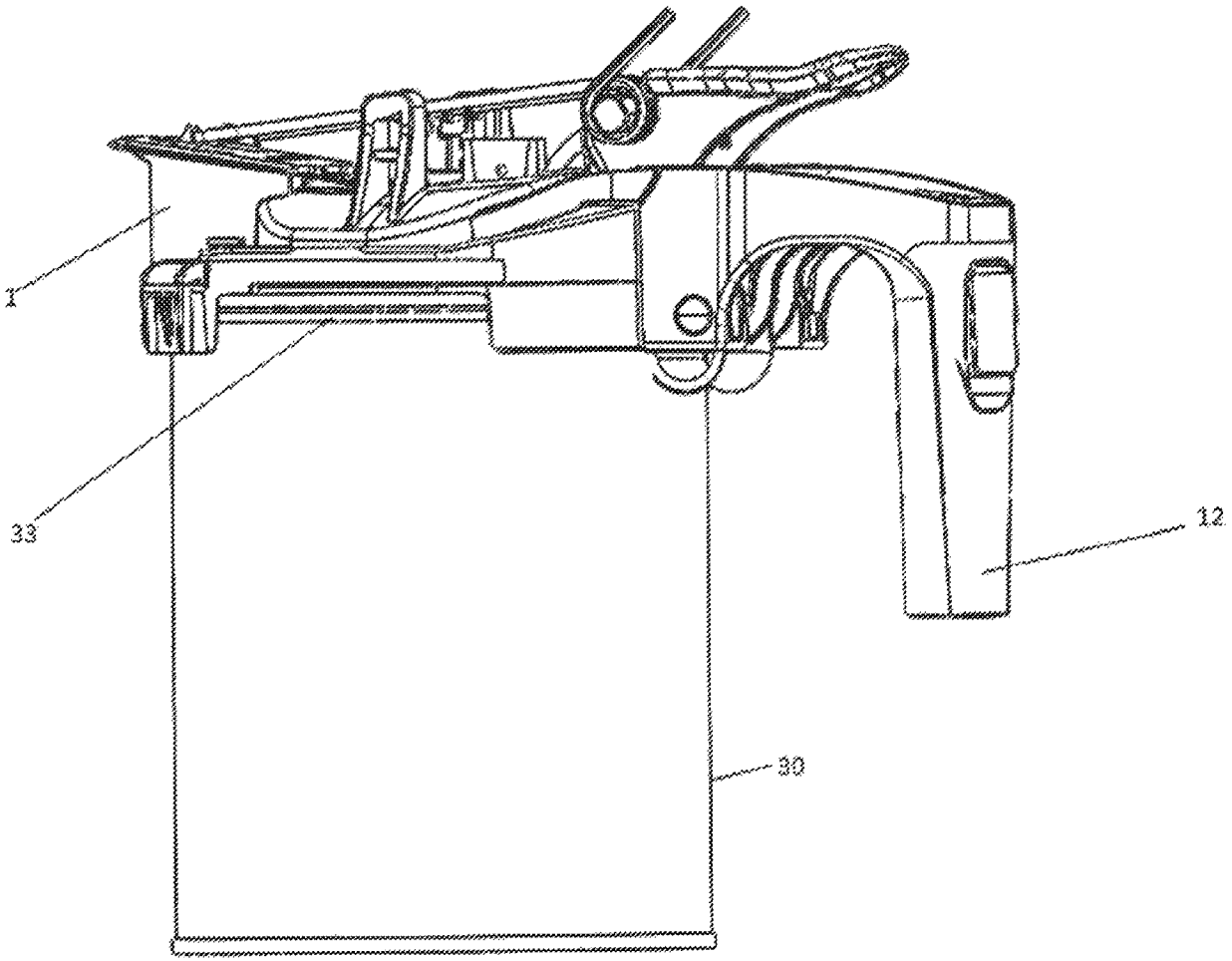
FIG. 4 is a perspective view of a lid-and-can assembly in which the active fastener portions of the catches are in the closer position and the pivotally movable catch is locked so that it is prevented from pivoting.
Figure 5:
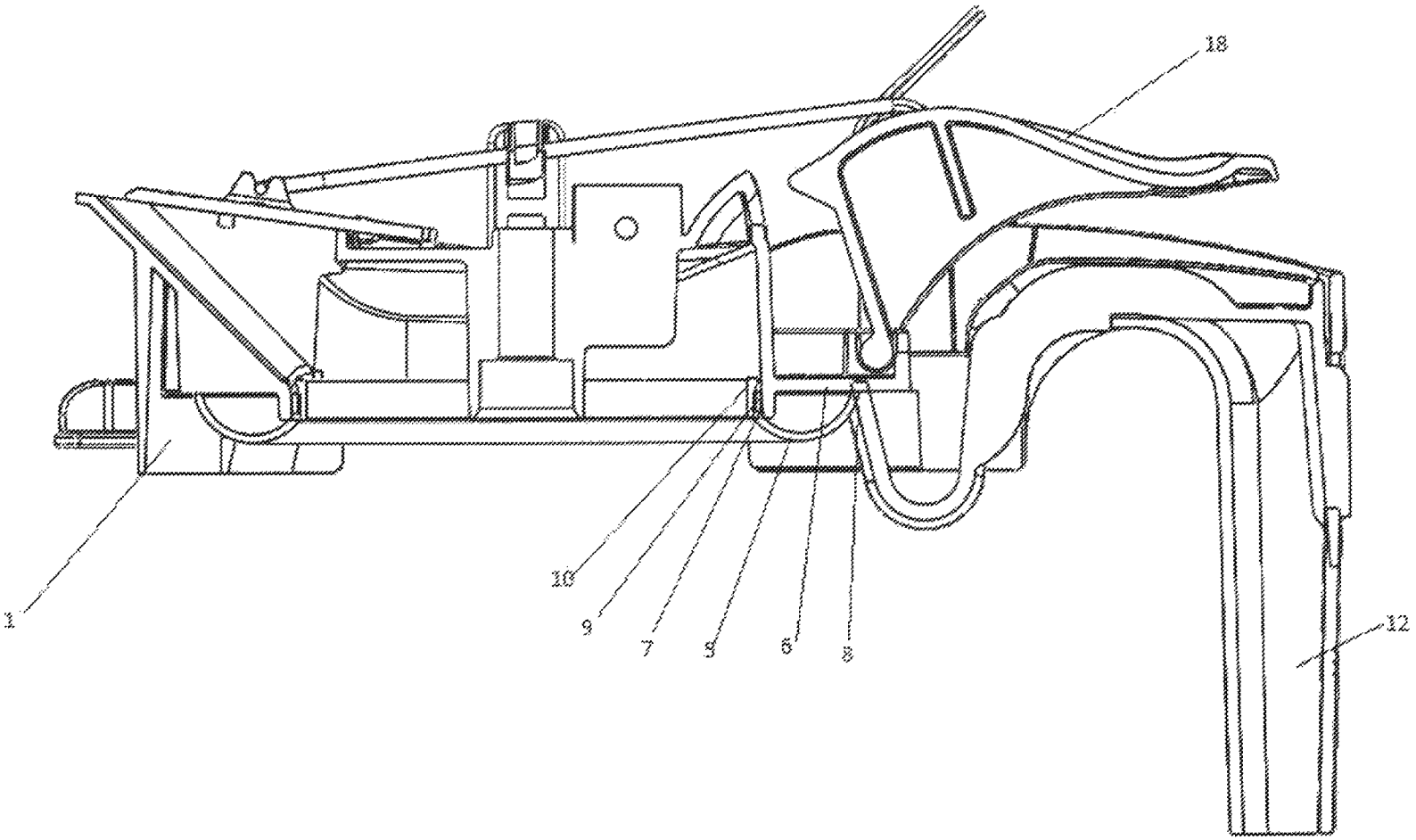
FIG. 5 is a section view of the lid with the pivotally movable catch being in the locked position.
Figure 6:
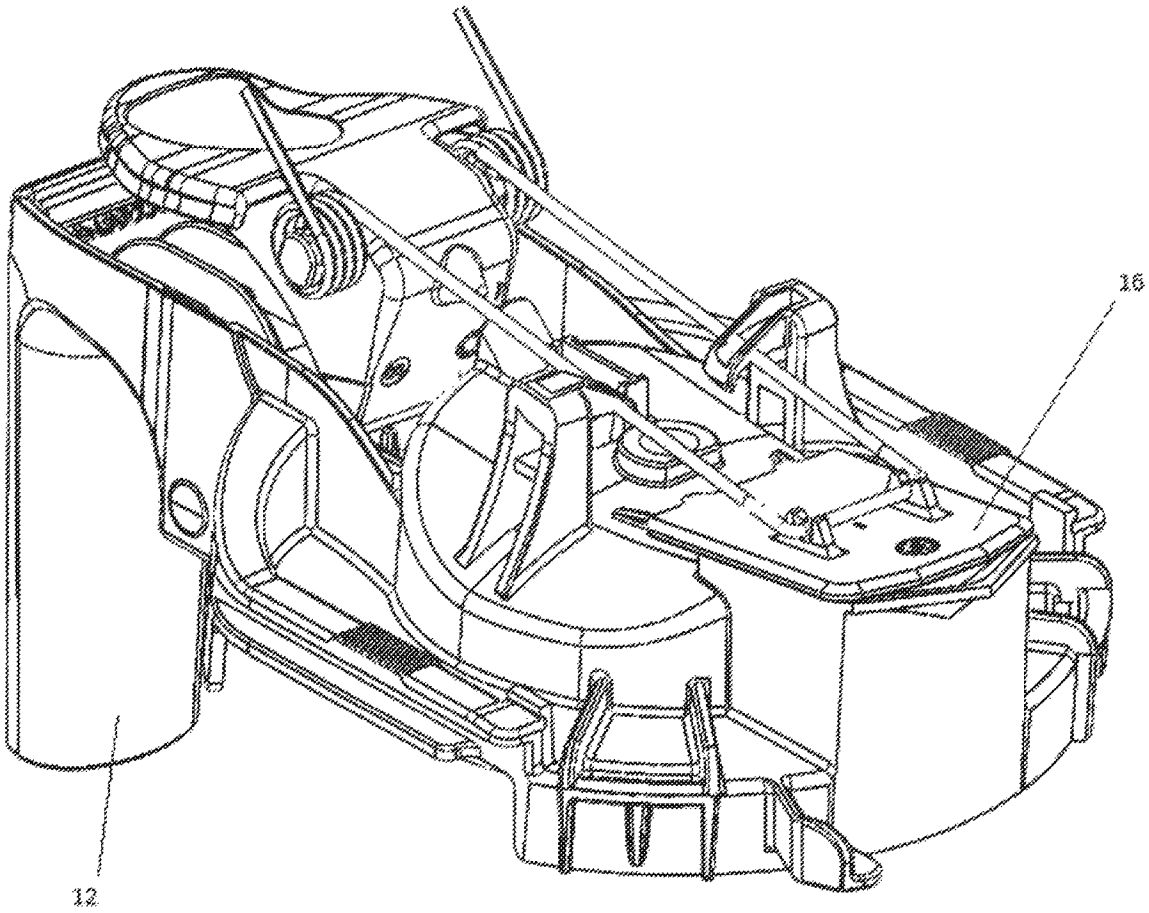
FIG. 6 is a perspective view of a lid, seen from another angle.
Figure 7:
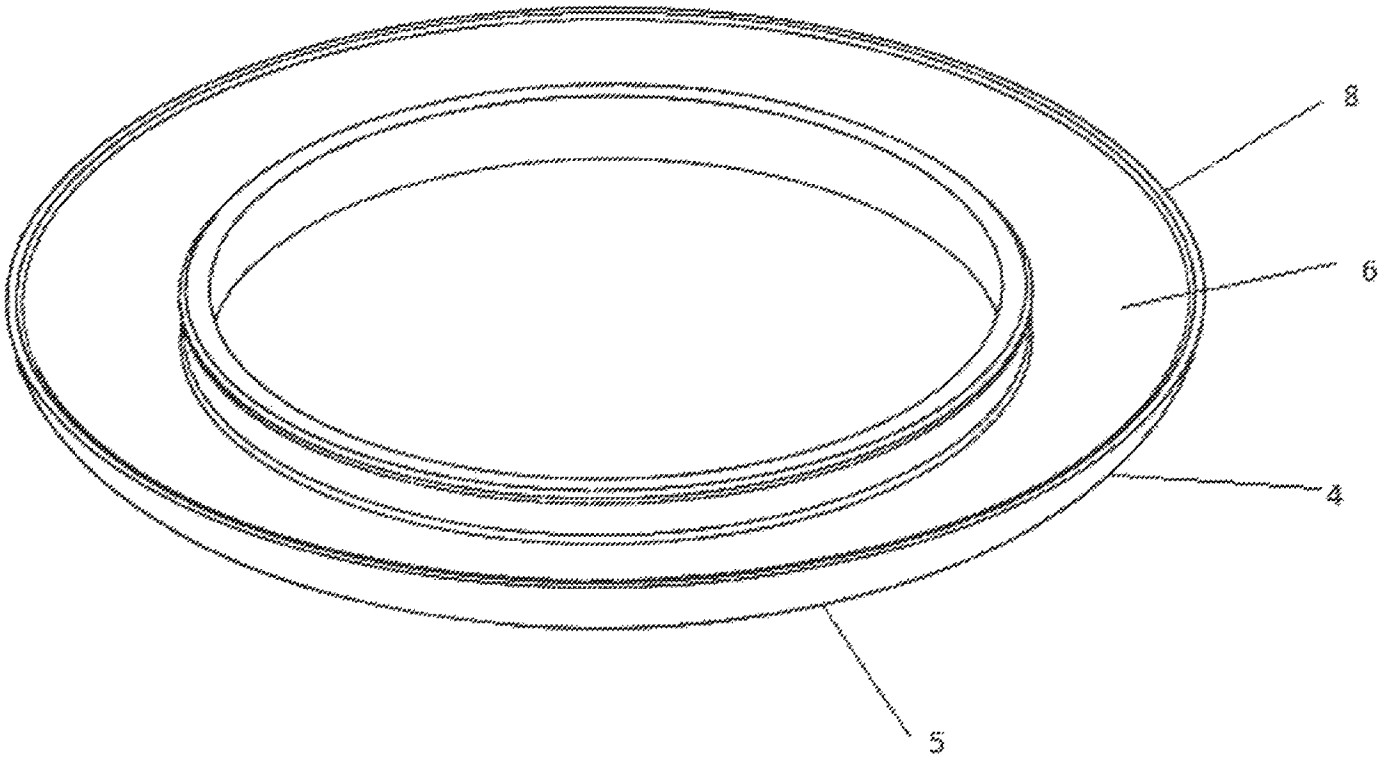
FIG. 7 is a perspective view of a gasket, on its own, seen from the face of the gasket that faces towards the bottom face of the lid.
Figure 8:
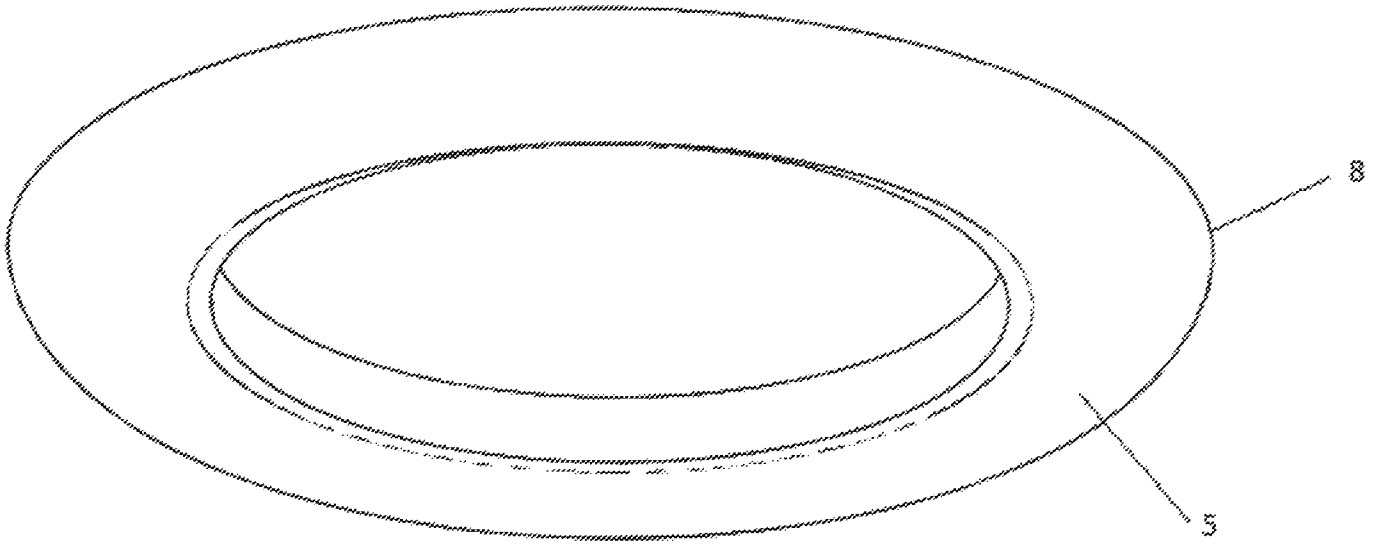
FIG. 8 is a perspective view of a gasket, on its own, seen from the convex face of the gasket that faces outwards from the lid.
Figure 9:
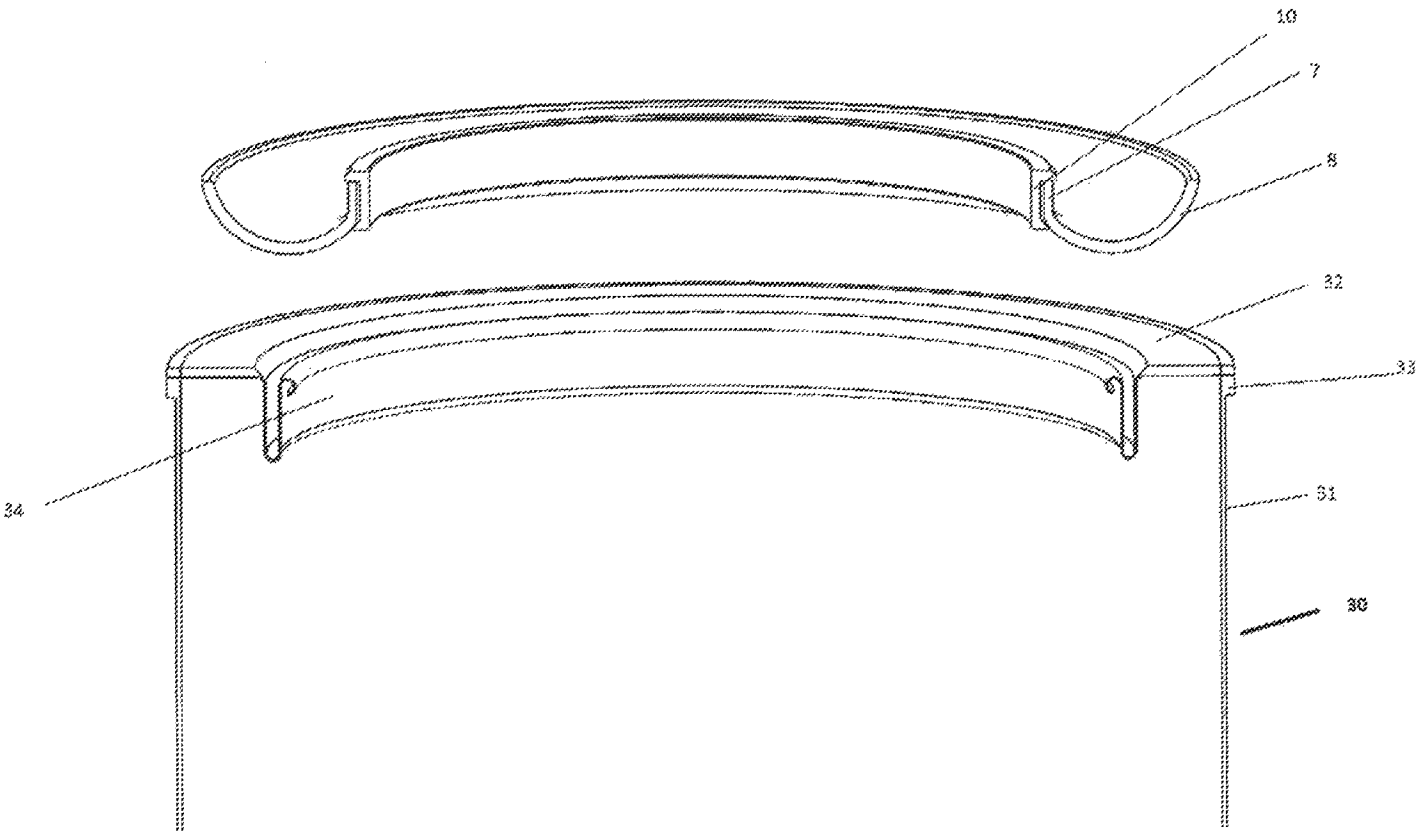
FIG. 9 is a fragmentary view of the gasket and of its annular fastening band for fastening to the lid, in the state in which the lid is positioned above a can.
Figure 10:
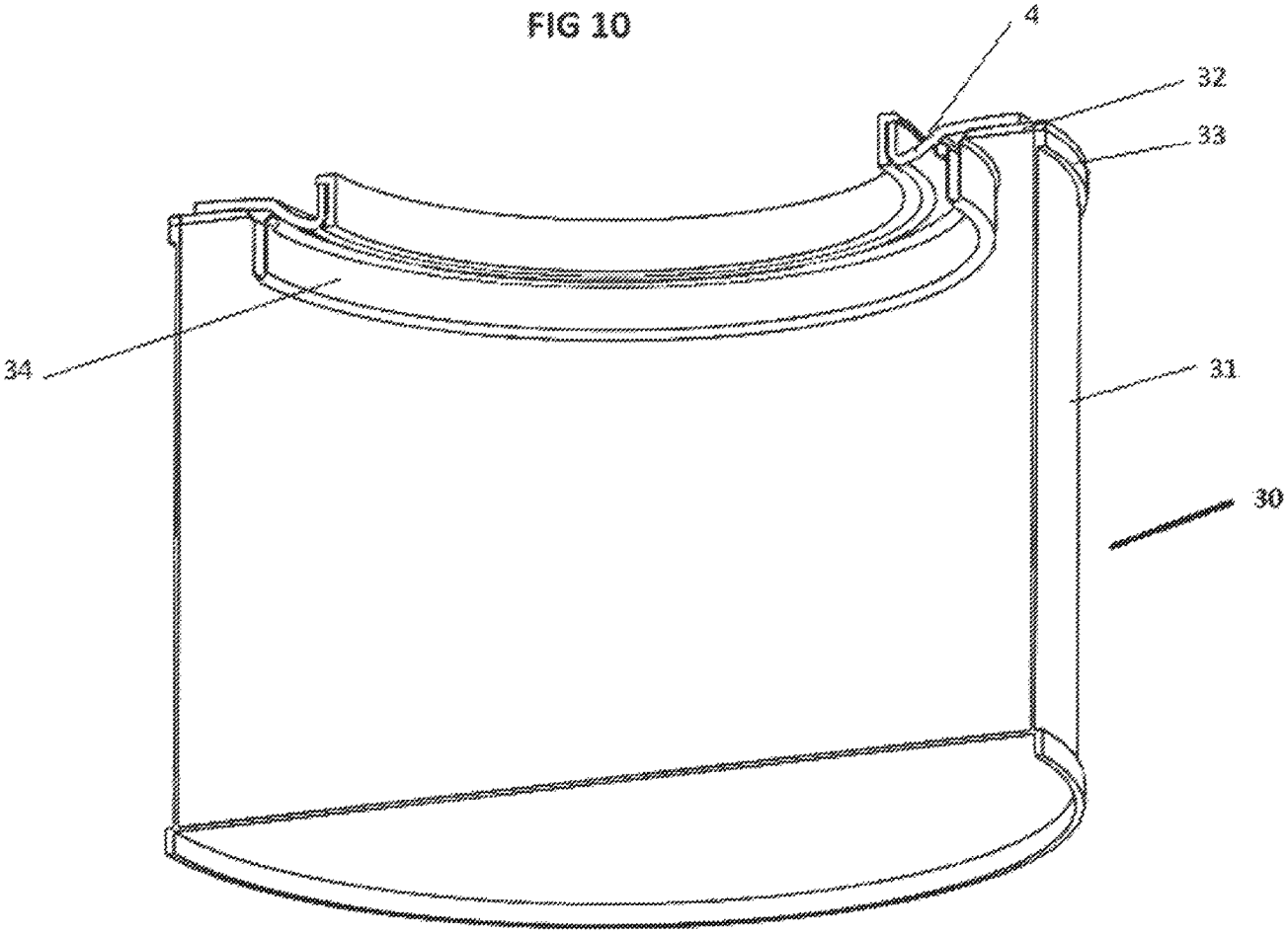
FIG. 10 is a fragmentary view of the gasket and of its annular fastening band for fastening to the lid, in the state in which the lid is applied against the top opening of the can.

In the example shown in FIG. 1B, the fastener means 14 comprise two rotary cam levers 141 that are spring-loaded by springs 142, and that are movable axially by "complementary" surfaces 143 carried respectively by the lid 1 and by the cam lever 141 co-operating while the cam levers 141 are being driven in rotation to go from a closed position in which the lid 1 is closed and in which the cam comes to bear under the collar 32 of the can 30 to an open position in which the cam is disengaged from said collar 32, axial movement of cam lever 141 in the direction in which the lid 1 moves farther away from the cam causing compression of the spring 142.

When the can is further provided with an external radial peripheral rim 33 disposed substantially at the same level as said top opening 34, the fastener means 14 may, instead of cam levers, comprise at least two catches 144 extending around said gasket 4 and at least partially projecting from the bottom face 2 of the lid 1.

At least one of the catches 144 may be mounted to be movable so that it can be moved closer to and farther away from the other catch(es) 144. At least two or each of the catches 144 have/has an active fastener portion 145 formed by a portion of the catch 144 that projects towards the center of the lid. The active portion 145 is suitable for positioning itself under said external radial peripheral rim 33 of the can 30 when said catches 144 are in a closer position corresponding to the active closure position in which the lid 1 is actively closed.

In an embodiment that is not shown, said catches may be implemented merely in the form of elastically deformable catches that, when the lid is positioned above the top opening of the can and moved towards said opening, move further apart on going over the external peripheral rim 33 of the can before coming closer together again under said rim and coming to engage with said rim.

Said patches may also be implemented in the form of three catches disposed around the annular gasket and extending projecting from the bottom face of the lid. These three catches are disposed in such a manner as to be mutually spaced apart around the circumference of the lid.

The bottom face 2 of the lid is provided, over at least a portion of its periphery, with an annular edge forming a dropped edge of the bottom face. This annular edge covers at least a portion of the tubular side wall 31 of the can when the lid is positioned over the top opening 34 of the can 30.

Two of the catches are rigid, catches formed integrally with said annular edge.

Each of the catches 144 has an active fastener portion formed by a portion of the catch that projects towards the center of the lid. The active fastener portion 145 of each of the rigid catches is formed by a latch or tooth provided on the surface of the catch that faces towards the center of the lid.

The third catch may be a movable catch that is movable between a closer position in which its active fastener portion 145 is closer to the active fastener portions of the other catches and a farther-away position in which its active fastener portion 145 is farther away from the active fastener portions of the other catches.

These active fastener portions are suitable for coming to position themselves under the external radial peripheral rim 33 of the can in the closer position corresponding to the active closure position of the lid, when the lid 1 is positioned over the top opening 34 of the can.

For moving its active fastener portion between a closer position in which it is closer to the active fastener portions of the other catches and a farther-away position in which it is farther away from the active fastener portions of the other catches, the third catch is mounted to move pivotally about an axis (XX') substantially parallel to a circumferential plane of the annular sealing gasket 4.

Figure 11:
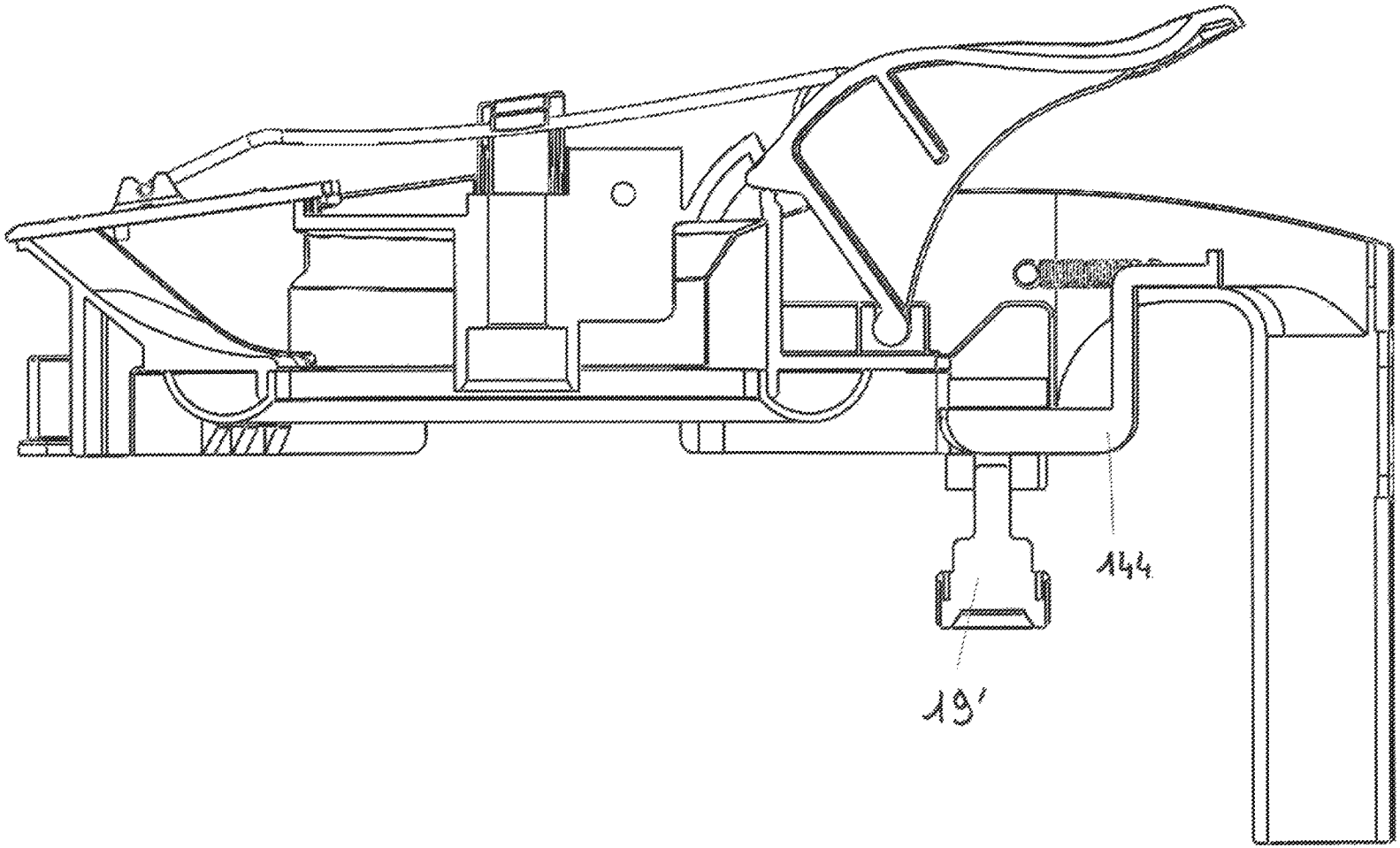
FIG. 11 is a section view of a lid, with the slidably movable catch being in the unlocked position.
Figure 12:
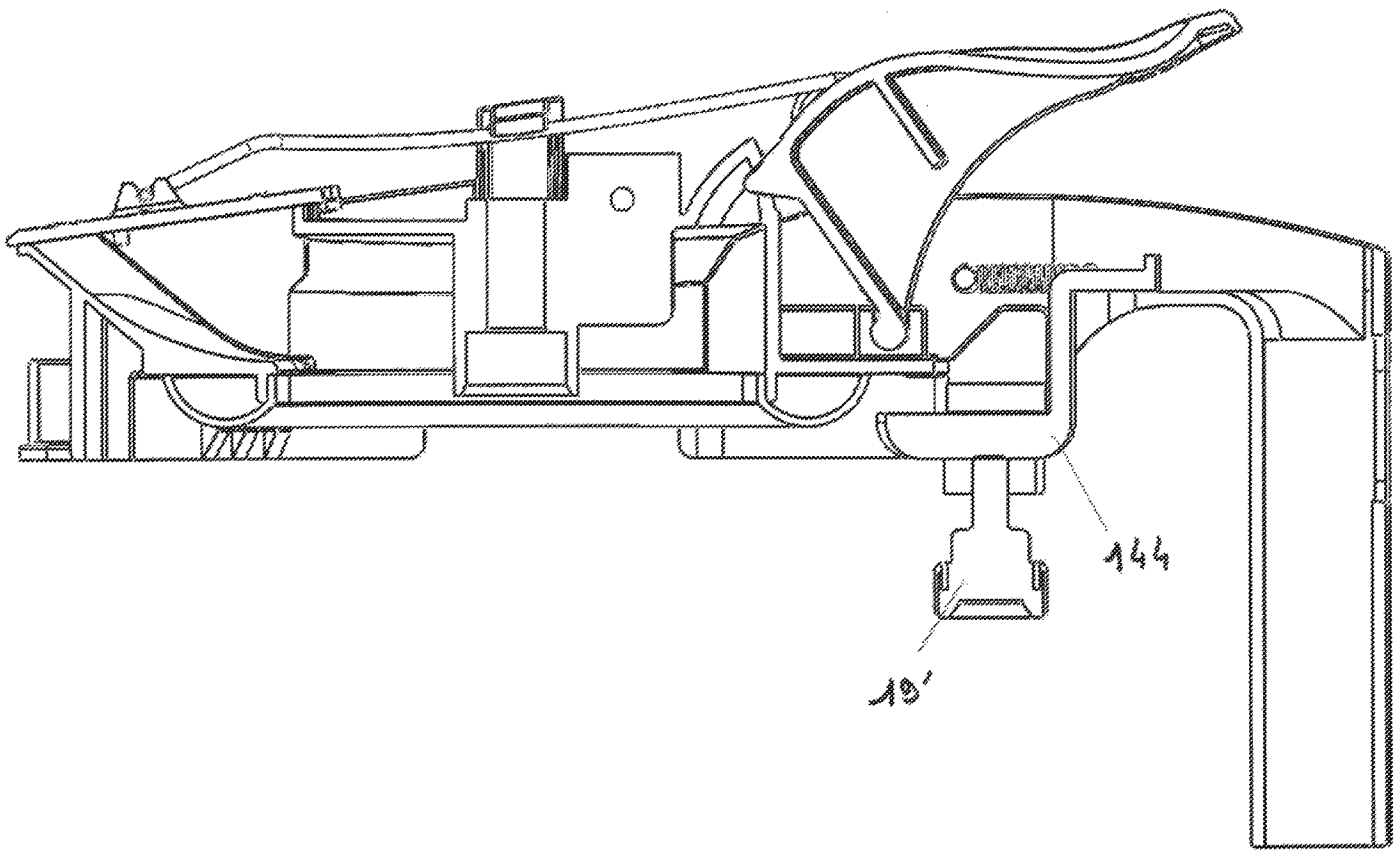
FIG. 12 is a section view of a lid, with the slidably movable catch being in the locked position.

As shown in FIGS. 11 and 12, for moving its active fastener portion between a closer position in which it is closer to the active fastener portions of the other catches and a farther-away position in which it is farther away from the active fastener portions of the other catches, the third catch may be mounted to slide in a plane substantially parallel to a circumferential plane of the annular sealing gasket 4.

Under such circumstances, said catch is spring-loaded by a spring, said spring tending to urge the slidably mounted catch back into the closer position in which its active fastener portion is closer to the active fastener position(s) of the other catch(es).

For said pivotally movable catch, the lid includes locking means 19 for preventing said pivotally movable catch from pivoting when its active fastener portion is in the closer position in which it is closer to the active fastener portions of the other catches, these locking means 19 being unlockable.

In the example shown, the pivotally movable catch is V-shaped between its pivot connection and its free end, the branch of the V-shape that carries, the free end of the catch forming the active fastener portion of the catch.

In the example shown, this active fastener portion of the pivotally movable catch is elastically deformable. The elastic deformation takes place by the branches of the V-shape moving closer together.

The other branch of the V-shape is provided with two pin portions, each of which engages into a respective pin bearing provided in the remainder of the lid. The pin bearings and pin portions form the pivot connection elements enabling the pivotally movable catch 144 to be pivotally mounted.

For the purpose of operating the pivotally movable catch, the lid is provided with a control lever 20 for causing the catch to be pivotally moved. In this example, the control lever 20 is formed integrally with the catch and forms an extension to the branch of the V-shape of the catch that is equipped with a pivot connection.

The means 19 for locking the pivotally movable catch to prevent it from pivoting when its active fastener portion is in the closer position in which it is closer to the active fastener portions of the other catches comprise first locking means 191 mounted to be constrained to move with the pivotally movable catch, and stationary second locking means 192, these first and second locking means being coupled together in the locked position and decoupled in the unlocked position.

These first locking means 191 are formed by a latch or lug carried by the control lever 20 and the second locking means 192 are formed by a slot provided in the handle, and in particular in the vertical branch of the handle.

In the coupled state corresponding to the locked position, the latch is inserted into the slot.

For unlocking, since the lever is elastically deformable, it suffices to press on the latch to generate deformation of the lever, thereby enabling the latch to exit from the slot. Once unlocked, the movable catch can be caused to move pivotally in the direction in which its active fastener portion moves away from the active fastener portions of the other catches.

For locking, the reverse procedure applies: the pivotally movable catch is caused to move pivotally in the direction in which its active fastener portion moves closer to the other active fastener portions or closer to the center of the lid, until a position is reached in which the latch carried by the control lever 20 for causing the catch to move comes, by snap-fastening, to be received in the slot provided in the handle 12.

When the movable catch is a slidably movable catch, the locking means 19 for preventing the catch from sliding are formed by thumbscrew that can be tightened or loosened in the lid, the free end of the thumbscrew coming to bear against the catch in the locked position.

In the examples shown, the lid is also provided with a handle 12. This external radial handle 12 is in the form of an upside-down L-shape.

It should be observed that in the example shown, the horizontal branch of the upside-down L-shape of the handle is hollow to make it possible to receive the control lever 20 for causing the pivotally movable catch to move and to go from one position to another.

In the examples shown, the lid also has a top face 3 opposite from the bottom face 2 and that forms a pouring spout 15. The pouring spout 15 has a seat 151 for a closure flap 16. The seat 151 is formed by the open top surface of the pouring spout.

In the examples shown, the seat 151 of the pouring spout 15 slopes downwards from the periphery towards the center of the lid 1. The closure flap 16 is a sliding closure flap equipped with return means 17 for urging it back into the closed position, and with a pivotally mounted active opening control 18 acting against said return means 17. The pivotally mounted control lever 18 for opening the closure member 16 overlies the pivotally movable catch.

In this example, the closure flap 16 is formed merely by a plate, and the return means 17 are implemented in the form of a hairpin spring; the manner in which this spring co-operates with the closure flap is already known from the state of the art and is therefore not described in detail.

The pivotally mounted control lever 18 for opening the closure flap 16 that overlies the pivotally or slidably movable catch is mounted to move pivotally about an axis parallel to the pivot axis (XX') or to the plane of movement of the pivotally movable catch that it overlies.

This pivotally mounted opening control lever 18 for opening the closure flap 16 also, if necessary, when the closure flap is caused to open, forms a locking control member for locking the locking means 19 for preventing pivoting of the pivotally movable catch that underlies said lever 18, when said movable catch is a pivotally movable catch.

Specifically, if the control lever 20 for causing the movable catch to pivot has not already been actuated to bring the movable catch into the locked position, it can be actuated by the pivotally mounted opening control lever 18 for opening the closure flap 16 that overlies it.

Thus, the closure flap going from the closed position to the open position can make it possible, in parallel, for the catch to go from the unlocked position to the locked position.

When the lid 1 is a stirrer lid, the lid 1 is also provided with a central opening 13 designed for the rotary shaft of a mixer assembly.

In practice, closing a can by using a lid as described above can take place as follows: the lid 1 is positioned with its bottom face facing the top opening of the can. The pivotally movable catch of the lid is unlocked and its active fastener portion is farther away from the active fastener portions of the other fastening catches or from the center of the lid.

The active fastener portions of the rigid, i.e. non pivotally mounted, catches are positioned under the external radial peripheral rim 33 of the can. Via its control lever 20 that is operated by the operator's hand that is holding the handle 12 for taking hold of the the pivotally movable catch is caused to move pivotally into a position in which the active fastener portion of the pivotally movable catch is disposed by bearing against the bottom face of the external radial peripheral rim 33, i.e. the face of the external radial peripheral rim 33 that faces towards the bottom of the can that is opposite from the end face of the can that carries, the top opening.

When the catch is in this position, the latch 191 of the control lever 20 for causing the movable catch 144 to pivot engages in the slot 192 of the handle and the catch is locked so that any pivotal movement of the catch 144 in an opposite direction is prevented.

Fastening the lid 1 to the can is complete.

In a variant, provision may be made firstly to bring the active fastener portion of the pivotally movable catch under the peripheral rim of the can before exerting thrust on the lid and before pushing the lid to bring the active fastener portions of the rigid catches 144 under the peripheral rim of the can. Actuating the movable catch and locking it then take place as described above.

When the movable catch is a slidably movable catch, as shown in FIG. 11, the operator exerts traction on the catch 144 against the action of the spring in order to move it farther away from the other catches and then releases said catch whose active fastener portion comes to be positioned under the external radial peripheral rim of the can in the position in which it bears against the outside face of the peripheral wall of the can. Locking is then performed to lock said catch in position.

The closure flap of the pouring spout can be actuated to move in the opening direction by means of the pivotally mounted lever 18. Releasing the lever 18 automatically causes the closure flap to return to the closed position, by it being urged back by the return means 17.

To separate the lid from the can, it suffices to exert pressure on the latch 191 in the direction in which the latch 191 is extracted from the slot 192, and then to cause the catch 143 to be moved pivotally in the direction in which the active fastener portion of the catch moves farther away from the active fastener portions of the other catches or from the center of the lid.

For actuating of the pivotally movable catch so that it moves in the direction in which its active fastener portion moves closer to the active fastener portions of the other catches, it is possible to act on the operating lever 18 for operating the closure flap, this lever 18 coming, during its pivoting, to bear against the operating lever 20 and causing it to move into an end-of-stroke position in which it is locked.

It should be observed that operating the control lever 18 for opening the closure member and operating the control lever 20 for causing the catch 144 to move pivotally is performed by the operator's hand that is holding the handle 12. It is the thumb of that hand that makes it possible to act on the two levers.

Thus, in spite of the presence of two levers, a single hand suffices to actuate both of the levers.

The invention claimed is:

1. A lid for closing a can, the can having a tubular side wall provided with a top opening, the can also having an internal radial collar disposed substantially at the same level as said top opening, said lid comprising:

on its bottom face, an elastically deformable annular sealing gasket that is suitable for coming to bear against said collar, when the top opening of the can is in the closed state in which it is closed by said lid;

wherein in a non-deformed state, said sealing gasket is in the general shape of a half-torus having its convex side facing outwards from the lid so that the face of the gasket that faces towards the bottom face of the lid corresponds to the face of the gasket that contains a section plane of the half-torus, wherein the sealing gasket is fastened to the lid via an annular band or via an annular snap ring, said snap ring defining an open ring.

2. The lid according to claim 1, wherein the half-torus is hollow.

3. The lid according to claim 1, wherein the half-torus is open on its face that faces towards the lid.

4. The lid according to claim 1, wherein the half-torus that has an inner circumferential edge and an outer circumferential edge is connected to the lid via a connection zone disposed at one of its circumferential edges, and in that the other circumferential edge of the half-torus is free.

5. The lid according to claim 1, wherein the half-torus that has an inner circumferential edge and an outer circumferential edge is connected to the lid via a connection zone disposed at each of its circumferential edges.

6. The lid according to claim 1, wherein said lid is provided with a handle and a central opening designed to receive the rotary shaft of a mixer assembly.

7. The lid according to claim 1, wherein said lid is provided with fastener means for fastening the lid to the can.

8. The lid according to claim 7, wherein the fastener means comprise two rotary cam levers that are spring-loaded by springs, and that are movable axially by complementary surfaces carried respectively by the lid and by the cam levers co-operating while the cam levers are being driven in rotation to go from a closed position in which the lid is closed and in which the cam comes to bear under the collar of the can to an open position in which the cam is disengaged from said collar, axial movement of the cam levers in the direction in which the lid moves farther away from the cam causing compression of the spring.

9. The lid according to claim 7, of wherein said lid is also provided with an external radial peripheral rim disposed substantially at the same level as said top opening, said lid being characterized in that the fastener means comprise at least two catches extending around said gasket, and at least partially projecting from the bottom face of the lid, at least one of the catches being mounted to move closer to or farther away from the other catches, at least two of or each of the catches having an active fastener portion formed by a portion of the catch that projects towards the center of the lid, this active fastener portion being suitable for coming to position itself under said external radial peripheral rim of the can when said catches are in the closer position corresponding to the active closure position of the lid.

10. The lid according to claim 1, wherein said top face of the lid that is opposite from its bottom face forms a pouring spout, said pouring spout having a seat for a closure member, said seat sloping downwards from the outer peripheral edge towards the center of the lid, said closure member being equipped with return means for urging said closure member back into the closed position, and with a pivotally mounted control lever for opening an active closure flap against the action of said return means.

11. The lid according to claim 1, wherein the half-torus is hollow, and wherein the half-torus that has an inner circumferential edge and an outer circumferential edge, the half-torus being connected to the lid via a connection zone disposed at one of its circumferential edges.

12. The lid according to claim 1, wherein when the band is used, the band is engaged by force in an annular recess in the bottom face of the bottom of the lid.

13. The lid according to claim 1, wherein when the band is used, the band and gasket are overmolded.

* * * * *